US005791729A

United States Patent [19]

McCormick et al.

[11] Patent Number: 5,791,729

[45] Date of Patent: Aug. 11, 1998

[54] WALL-MOUNTED FOLD DOWN SEAT

[76] Inventors: Tracy L. McCormick; Anthony J. McCormick, both of 706 S. Oak Park Ave., Oak Park, Ill. 60304

[21] Appl. No.: 916,483

[22] Filed: Aug. 22, 1997

[51] Int. Cl.[6] ..... A47K 1/00

[52] U.S. Cl. ..... 297/14; 297/39; 297/335

[58] Field of Search ..... 297/14, 35, 60, 297/238, 256, 335, 39

[56] References Cited

U.S. PATENT DOCUMENTS

| | | | |
|---|---|---|---|
| 1,642,125 | 9/1927 | Nelson | 297/14 |
| 2,107,813 | 2/1938 | Best | 297/188.148 |
| 2,583,372 | 1/1952 | Hall | 297/14 |
| 2,676,644 | 4/1954 | Fleisher et al. | 297/335 X |
| 5,100,199 | 3/1992 | Vander Stel et al. | 297/238 |

FOREIGN PATENT DOCUMENTS

| | | | |
|---|---|---|---|
| 447178 | 5/1936 | United Kingdom | 297/256 |

*Primary Examiner*—Peter R. Brown

[57] ABSTRACT

A wall-mounted fold down seat is provided including a generally planar seat back having a front surface, a rear surface, and a periphery formed therebetween defined by a top edge, a bottom edge, and a pair of side edges. The seat back has a mounting mechanism formed thereon for allowing the mounting of the seat back flush with a recipient wall. Next provided is a generally planar seat bottom having a top surface, a bottom surface, and a periphery formed therebetween defined by a front edge, a rear edge, and a pair of side edges. The rear edge of the periphery is pivotally coupled to the bottom edge of the seat bottom. The seat further has a handle for facilitating the pivoting thereof between a raised and lowered orientation.

5 Claims, 3 Drawing Sheets

WALL-MOUNTED FOLD DOWN SEAT

BACKGROUND OF THE INVENTION

1. Field of the Invention

The present invention relates to a wall-mounted fold down seat and more particularly pertains to allowing a user to nurse a child in a rest room with a seat that requires minimal spaced when not in use.

2. Description of the Prior Art

The use of fold down seats is known in the prior art. More specifically, fold down seats heretofore devised and utilized for the purpose of sitting are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,362,123; U.S. Pat. No. 5,310,242; U.S. Pat. No. Des. 333,923; U.S. Pat. No. 4,723,493; U.S. Pat. No. 4,902,069; and U.S. Pat. No. 4,270,794.

In this respect, the wall-mounted fold down seat according to the present invention substantially departs from the conventional concepts and designs of the prior art, and in so doing provides an apparatus primarily developed for the purpose of allowing a user to nurse a child in a rest room with a seat that requires minimal spaced when not in use.

Therefore, it can be appreciated that there exists a continuing need for a new and improved wall-mounted fold down seat which can be used for allowing a user to nurse a child in a rest room with a seat that requires minimal spaced when not in use. In this regard, the present invention substantially fulfills this need.

SUMMARY OF THE INVENTION

In view of the foregoing disadvantages inherent in the known types of fold down seats now present in the prior art, the present invention provides an improved wall-mounted fold down seat. As such, the general purpose of the present invention, which will be described subsequently in greater detail, is to provide a new and improved wall-mounted fold down seat which has all the advantages of the prior art and none of the disadvantages.

To attain this, the present invention essentially comprises a generally planar seat back with a square configuration. The seat back is defined by a front surface, a rear surface, and a periphery formed therebetween consisting of a linear top edge, a linear bottom edge, and a pair of linear side edges. The bottom edge of the periphery of the seat back has a pair of tabs integrally coupled thereto adjacent to respective side edges of the seat back and in coplanar relationship therewith, as shown in FIGS. 1 & 2. For reasons that will become apparent hereinafter, the tabs are equipped with a pair of coaxially aligned apertures. As shown in FIG. 5, the seat back has a plurality of mounting holes formed therein for allowing the mounting of the seat back to a recipient wall. Shown in FIG. 4 is a first pair of rectangular arm rest wells formed along the side edges of the front surface of the seat back adjacent to the top edge thereof. Associated therewith is a generally planar seat bottom with a square configuration having a top surface, a bottom surface, and a periphery formed therebetween. The periphery is defined by a linear front edge, a linear rear edge, and a pair of linear side edges. The rear edge of the periphery has a bore formed adjacent thereto between the side edges of the periphery of the seat bottom. Such bore is adapted for allowing the pivotal coupling thereof with the apertures of the tabs of the seat back by way of a coupling rod or the like. For facilitating the pivoting thereof between a raised and lowered orientation, the bottom surface of the seat bottom has an elongated recess formed therein adjacent to and parallel with the front edge. The top surface of the seat bottom has a second pair of arm rest wells formed along the side edges. Next provided is a pair of arm rests each with an inboard end pivotally coupled to a central extent of an associated one of the side edges of the seat back. Such coupling is situated at a bottom of an associated one of the first pair of arm rest wells, as shown in FIG. 4. As such, the arm rests are adapted to rotate within separate vertical planes between a first orientation within the first pair of rectangular arm rest wells when the seat bottom is raised and a second orientation perpendicular with respect to the seat back when the seat bottom is lowered. Each arm rest is equipped with a circular bore formed therein adjacent an outboard end for receiving a bottle. FIG. 4 further depicts each arm rest having a tapered recess formed on a bottom surface thereof adjacent to the seat back. Finally, an arm rest support assembly is provided including a pair of elongated strips each having a first end pivotally coupled to a central extent of the arm rests. A second end of each elongated strip is pivotally coupled to a corresponding one of the side edges of the seat bottom adjacent the rear edge thereof. This coupling is preferably afforded at an end of an associated one of the second pair of arm rest wells. The elongated strips are situated in perpendicular relationship with the arm rests and the seat bottom when the arm rests are in the second orientation thereof. Further, the elongated strips are situated within the tapered recesses and the second pair of arm rest wells when the arm rests are in the first orientation. By this structure, the front face of the seat back abuts the top face of the seat bottom during storage.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wall-mounted fold down seat which has all the advantages of the prior art fold down seats and none of the disadvantages.

It is another object of the present invention to provide a new and improved wall-mounted fold down seat which may be easily and efficiently manufactured and marketed.

It is a further object of the present invention to provide a new and improved wall-mounted fold down seat which is of a durable and reliable construction.

An even further object of the present invention is to provide a new and improved wall-mounted fold down seat which is susceptible of a low cost of manufacture with regard to both materials and labor, and which accordingly is then susceptible of low prices of sale to the consuming public, thereby making such wall-mounted fold down seat economically available to the buying public.

Still yet another object of the present invention is to provide a new and improved wall-mounted fold down seat which provides in the apparatuses and methods of the prior art some of the advantages thereof, while simultaneously overcoming some of the disadvantages normally associated therewith.

Still another object of the present invention is to allow a user to nurse a child in a rest room with a seat that requires minimal spaced when not in use.

Lastly, it is an object of the present invention to provide a new and improved that includes a generally planar seat back having a front surface, a rear surface, and a periphery formed therebetween defined by a top edge, a bottom edge, and a pair of side edges. The seat back has a mounting mechanism formed thereon for allowing the mounting of the seat back flush with a recipient wall. Next provided is a generally planar seat bottom having a top surface, a bottom surface, and a periphery formed therebetween defined by a front edge, a rear edge, and a pair of side edges. The rear edge of the periphery is pivotally coupled to the bottom edge of the seat bottom. The seat further has a handle for facilitating the pivoting thereof between a raised and lowered orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
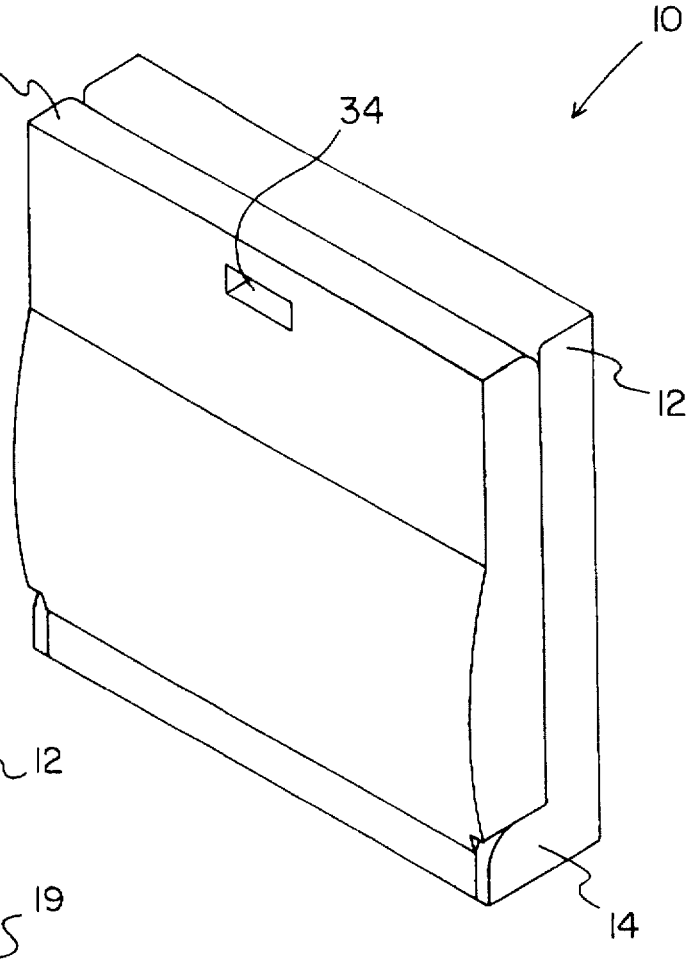
FIG. 1 is a front illustration of the preferred embodiment of the wall-mounted fold down seat constructed in accordance with the principles of the present invention.

With reference now to the drawings, and in particular to FIG. 1 thereof, a new and improved wall-mounted fold down seat embodying the principles and concepts of the present invention and generally designated by the reference numeral 10 will be described.

The present invention, the new and improved wall-mounted fold down seat, is comprised of a plurality of components. Such components in their broadest context include a seat bottom, a seat back, arm rests, and an arm rest assembly. Such components are individually configured and correlated with respect to each other so as to attain the desired objective.

Figure 2:
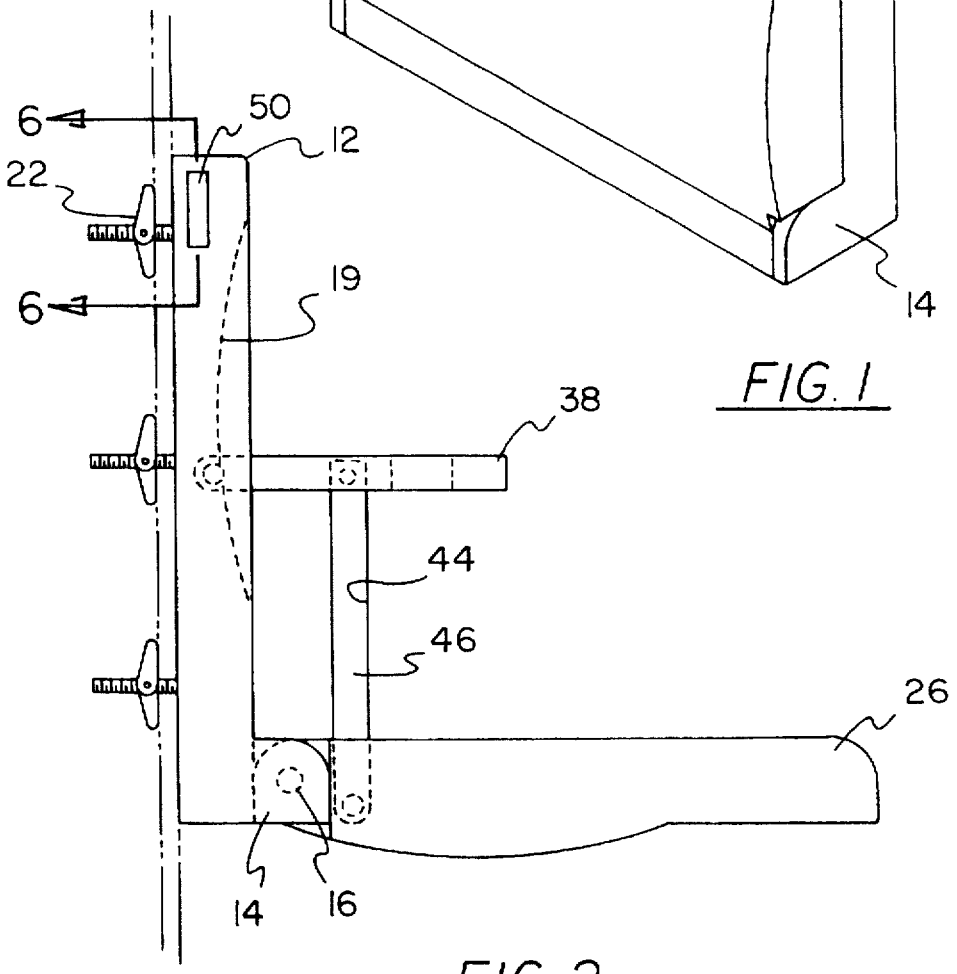
FIG. 2 is a side view of the present invention.
Figure 3:
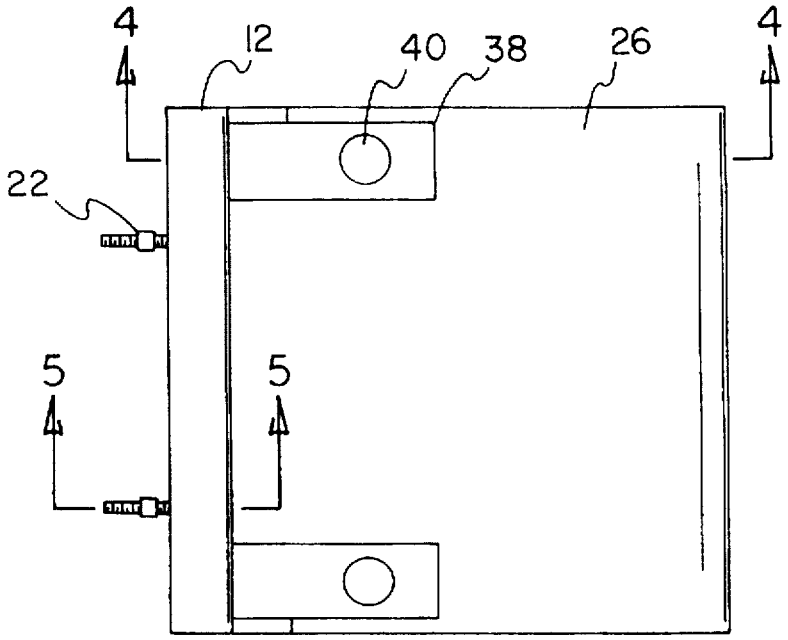
FIG. 3 is a top view of the present invention.
Figure 4:
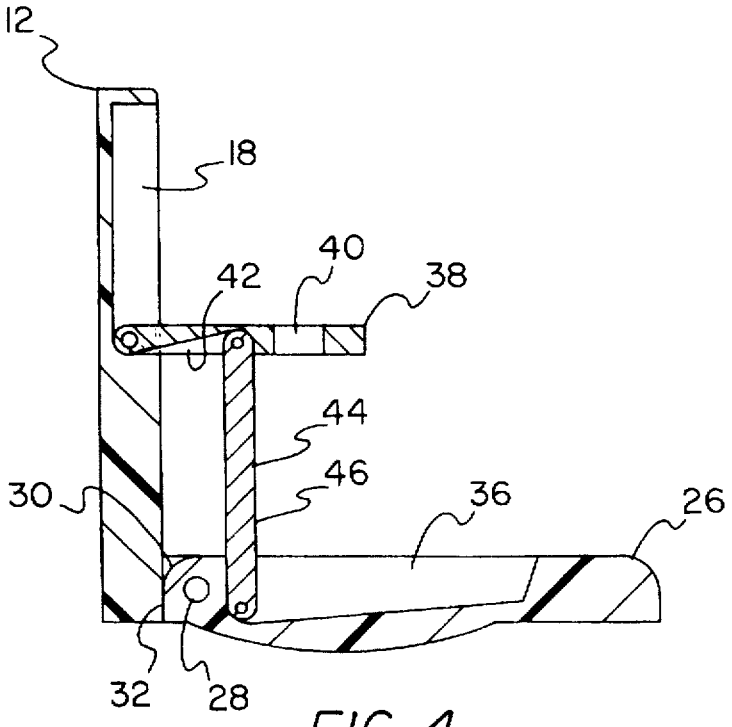
FIG. 4 is a side cross-sectional view of the present invention taken along line 4—4 shown in FIG. 3.

More specifically, it will be noted that the system 10 of the present invention includes a generally planar seat back 12 with a square configuration. The seat back is defined by a front surface, a rear surface, and a periphery formed therebetween consisting of a linear top edge, a linear bottom edge, and a pair of linear side edges. The bottom edge of the periphery of the seat back has a pair of tabs 14 integrally coupled thereto adjacent to respective side edges of the seat back and in coplanar relationship therewith, as shown in FIGS. 1 & 2. For reasons that will become apparent hereinafter, the tabs are equipped with a pair of coaxially aligned apertures 16. Shown in FIG. 4 is a first pair of rectangular arm rest wells 18 formed along the side edges of the front surface of the seat back adjacent to the top edge thereof. Further, the seat back is preferably equipped with a semi-spherical well 19 for supporting a back of a user during use, as will become apparent.

Figure 5:
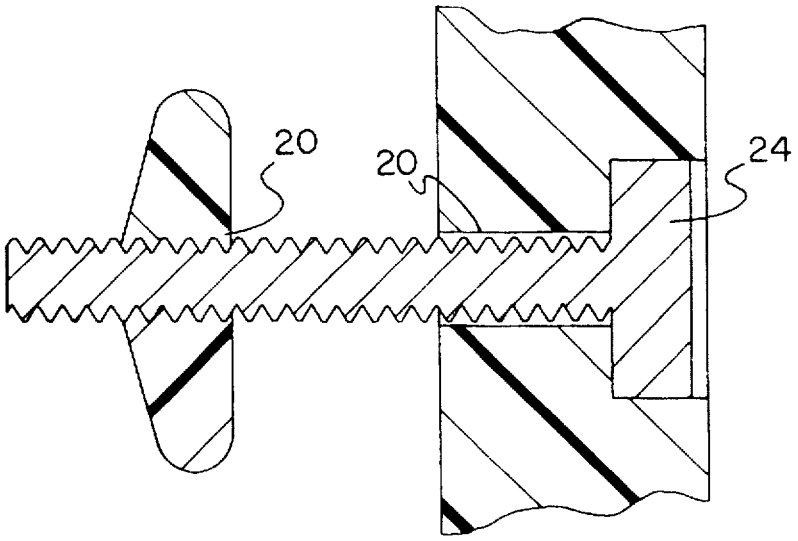
FIG. 5 is a cross-sectional view of the present invention taken along line 5—5 shown in FIG. 3.

As shown in FIG. 5, the seat back has a plurality of mounting holes 20 formed therein for allowing the mounting of the seat back to a recipient wall. Such mounting holes preferably allow the mounting of a toggle bolt 22 therein. Preferably, the toggle bolt is coupleable to a wall and has a flange 24 formed at an end thereof for being receiving in the mounting hole which ideally takes the form of an unillustrated vertical slot. By this design, the seat back may be removably mounted on the walls. It should be noted that simpler designs for the mounting hole such as that shown in FIG. 5 may also be employed to coupled the toggle bolt with the seat back.

Associated with the seat back is a generally planar seat bottom 26 with a square configuration having a top surface, a bottom surface, and a periphery formed therebetween. The periphery is defined by a linear front edge, a linear rear edge, and a pair of linear side edges. Similar to the seat back, the seat bottom is preferably constructed from heavy duty plastic. The rear edge of the periphery has a bore 28 formed adjacent thereto between the side edges of the periphery of the seat bottom. Such bore is adapted for allowing the pivotal coupling thereof with the apertures of the tabs of the seat back by way of a coupling rod or the like. As shown in FIG. 4, the rear edge of the seat bottom has an arcuate upper portion 30 and a vertical planar lower portion 32. Such design is critical to ensure that the seat bottom may only pivot within a range of 90 degrees between a raised and lowered orientation.

For facilitating the pivoting thereof between the raised and lowered orientation, the bottom surface of the seat bottom has an elongated recess 34 formed therein adjacent to and parallel with the front edge. The top surface of the seat bottom has a second pair of arm rest wells 36 formed along the side edges. Each of the second pair of arm rest wells preferably has a depth which increases from a front edge to a rear edge of the seat bottom. Further, a thickness of the seat bottom is greater along the length of the second pair of arm rest wells for ensuring that strength is not sacrificed.

Next provided is a pair of arm rests 38 each with an inboard end pivotally coupled to a central extent of an associated one of the side edges of the seat back. Such coupling is situated at a bottom of an associated one of the first pair of arm rest wells, as shown in FIG. 4. As such, the arm rests are adapted to rotate within separate vertical planes between a first orientation within the first pair of rectangular arm rest wells when the seat bottom is raised and a second orientation perpendicular with respect to the seat back when the seat bottom is lowered.

Each arm rest is equipped with a circular bore 40 formed therein adjacent an outboard end for receiving a bottle. FIG. 4 further depicts each arm rest having a tapered recess 42 formed on a bottom surface thereof adjacent to the seat back. Such recess has a depth which decreases from a central extent of the arm rest to the point of coupling with the seat back. It should be noted from the Figures that the arm rests each have a length half that of the seat bottom.

Finally, an arm rest support assembly 44 is provided including a pair of elongated strips 46 each having a first end pivotally coupled to a central extent of the arm rests. A second end of each elongated strip is pivotally coupled to a corresponding one of the side edges of the seat bottom adjacent the rear edge thereof. This coupling is preferably afforded at an end of an associated one of the second pair of arm rest wells. The elongated strips are situated in perpendicular relationship with the arm rests and the seat bottom when the arm rests are in the second orientation thereof. Further, the elongated strips are situated within the tapered recesses and the second pair of arm rest wells when the arm rests are in the first orientation. By this structure, the front face of the seat back completely abuts the top face of the seat bottom during storage thereby rendering a compactly stored device.

Figure 6:
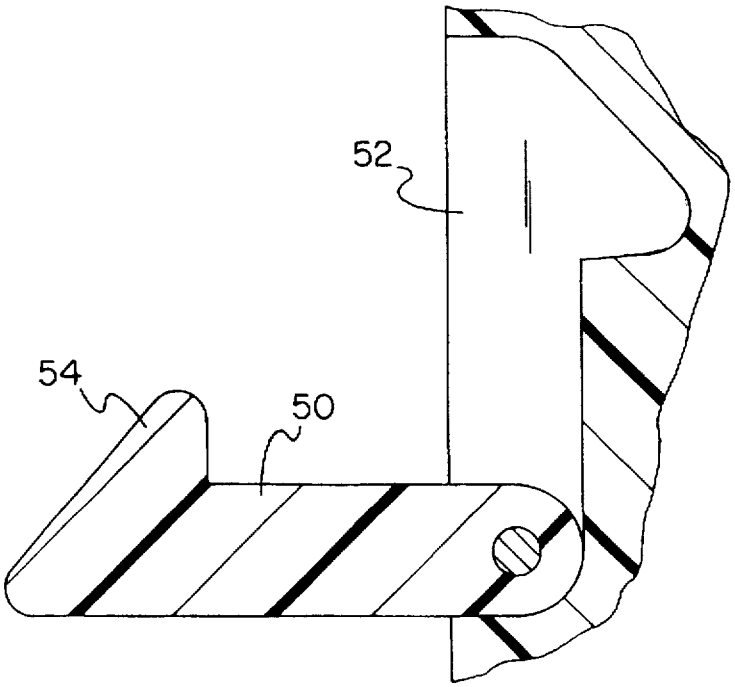
FIG. 6 is a cross-sectional view of the present invention taken along line 6—6 shown in FIG. 2.

As an option, a hanger 50 may be included, as shown in FIG. 6. Such hanger has a first stored orientation within a recess 52 formed in one of the side edges of the seat back and a second orientation extending perpendicularly therefrom. The hanger ideally has an upturned hook 54 formed at a free end thereof.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved wall-mounted fold down seat comprising, in combination:

a generally planar seat back with a square configuration having a front surface, a rear surface, and a periphery formed therebetween defined by a linear top edge, a linear bottom edge, and a pair of linear side edges, the bottom edge of the periphery of the seat back having a pair of tabs integrally coupled thereto adjacent to respective side edges of the seat back and in coplanar relationship therewith, the tabs having a pair of coaxially aligned apertures formed therein, the seat back having a plurality of mounting holes formed therein for allowing the mounting of the seat back to a recipient wall, the front surface of the seat back having a first pair of rectangular arm rest wells formed along the side edges adjacent to the top edge;

a generally planar seat bottom with a square configuration having a top surface, a bottom surface, and a periphery formed therebetween defined by a linear front edge, a linear rear edge, and a pair of linear side edges, the rear edge of the periphery having a bore formed adjacent thereto between the side edges of the periphery of the seat bottom for allowing the pivotal coupling thereof with the apertures of the tabs of the seat back by way of a coupling rod, the bottom surface of the seat bottom having an elongated recess formed therein adjacent to and parallel with the front edge of the seat bottom for facilitating the pivoting thereof between a raised and lowered orientation, the top surface of the seat bottom having a second pair of arm rest wells formed along the side edges;

a pair of arm rests each with an inboard end pivotally coupled to a central extent of an associated one of the side edges of the seat back at a bottom of an associated one of the first pair of arm rest wells wherein the arm rests are adapted to rotate within separate vertical planes between a first orientation within the first pair of rectangular arm rest wells and a second orientation perpendicular with respect to the seat back, each arm rest having a circular bore formed therein adjacent an outboard end for receiving a bottle, each arm rest having a tapered recess formed on a bottom surface thereof adjacent to the seat back; and an arm rest support assembly including a pair of elongated links each having a first end pivotally coupled to a central extent of the arm rests and a second end pivotally coupled to a corresponding one of the side edges of the seat bottom adjacent the rear edge thereof at an end of an associated one of the second pair of arm rest wells, whereby the elongated links are situated in perpendicular relationship with the arm rests and the seat bottom when the arm rests are in the second orientation thereof and further wherein the elongated links are situated within the tapered recesses and the second pair of arm rest wells when the arm rests are in the first orientation thereof for allowing the front face of the seat back to abut the top face of the seat bottom during storage.

2. A wall-mounted fold down seat comprising:

a generally planar seat back having a front surface, a rear surface, and a periphery formed therebetween defined by a top edge, a bottom edge, and a pair of side edges, the seat back having a mounting means formed thereon for allowing the mounting of the seat back flush with a recipient wall;

a generally planar seat bottom having a top surface, a bottom surface, and a periphery formed therebetween defined by a front edge, a rear edge, and a pair of side edges, the rear edge of the periphery pivotally coupled to the bottom edge of the seat bottom, the seat back having handle means for facilitating the pivoting thereof between a raised and lowered orientation;

a pair of arm rests each having an inboard end pivotally coupled to a central extent of an associated one of the side edges of the seat back wherein the arm rests are adapted to rotate within separate vertical planes between a first stored orientation and a second orientation perpendicular with respect to the seat back; and an arm rest support assembly including a pair of elongated links each having a first end pivotally coupled to a central extent of the arm rests and a second end pivotally coupled to a corresponding one of the side edges of the seat bottom adjacent the rear edge thereof, whereby the elongated links are situated in perpendicular relationship with the arm rests and the seat bottom when the arm rests are in the second orientation thereof and further wherein the elongated links are adapted for allowing the front face of the seat back to abut the top face of the seat bottom when the arm rests are in the first orientation;

wherein recesses are formed in at least one of the front surface of the seat back and the top surface of the seat bottom for allowing the arm rests and elongated links to reside therein.

3. A wall-mounted fold down seat as set forth in claim 2 wherein each arm rest has a circular bore formed therein adjacent an outboard end for receiving a bottle.

4. A wall-mounted fold down seat as set forth in claim 2 wherein the mounting means includes a plurality of mounting holes formed in the seat back.

5. A wall-mounted fold down seat as set forth in claim 2 wherein the handle means includes an elongated recess formed in the seat bottom adjacent to and parallel with the front edge of the seat bottom.

* * * * *